US005826290A

United States Patent [19]

Kokonis

[11] Patent Number: 5,826,290

[45] Date of Patent: Oct. 27, 1998

[54] REUSABLE COMPOSITE BRIDGE STRUCTURE AND METHOD OF CONSTRUCTING AND ATTACHING THE SAME

[75] Inventor: George D. Kokonis, West Vancouver, Canada

[73] Assignee: West Bridge Corp., Vancouver, Canada

[21] Appl. No.: 840,081

[22] Filed: Apr. 9, 1997

[51] Int. Cl.[6] ..... E01D 19/06; E01D 19/12

[52] U.S. Cl. ..... 14/73.1; 14/73

[58] Field of Search ..... 14/73, 73.1, 77.1, 14/74, 74.5, 77; 404/134, 70; 52/334, 335, 336, 417, 418, 471, 463, 606, 220.8

[56] References Cited

U.S. PATENT DOCUMENTS 1,688,723 10/1928 Lathrop ..... 52/335
5,311,629 5/1994 Smith ..... 14/73.1

*Primary Examiner*—Tamara L. Graysay
*Assistant Examiner*—Suuil Singh
*Attorney, Agent, or Firm*—Kolisch Hartwell Dickinson McCormack & Heuser

[57] ABSTRACT

A reusable composite bridge structure permits composite strength action of steel girders and concrete deck panels in a bridge structure that is removable and reusable. The bridge comprises precast concrete deck panels, each of the panels having a plurality of holes therein extending through the panels to match stud group locations on top flanges of steel girders, the holes having smooth inside surfaces through the panels, a plurality of shear studs at each of the stud group locations extending up from the top flanges, the shear studs having removable connections to the top flanges, and concrete grout filling the holes of the deck panels and between adjacent deck panels to provide a substantially flush deck surface, the concrete grout joining the shear studs and the panels to provide composite strength action between the deck panels and the bridge girders.

28 Claims, 4 Drawing Sheets

REUSABLE COMPOSITE BRIDGE STRUCTURE AND METHOD OF CONSTRUCTING AND ATTACHING THE SAME

TECHNICAL FIELD

The present invention relates to bridge structures formed of steel girders with precast concrete deck panels. More specifically, the present invention relates to a bridge structure which utilizes two steel girders with precast concrete deck panels that provide composite strength action of both materials, and wherein the deck panels can be disassembled and components of the bridge reused.

BACKGROUND ART

A typical forestry type permanent bridge installed on logging roads and the like uses two steel girders which act in composite action with precast concrete deck panels. In order for the steel and concrete to have composite strength it is necessary to have rigid connections between the two. Steel girders with a bolt down concrete deck do not provide composite strength. Thus, if a bridge is to be built which has a bolt down deck, then the steel girders and other framework must be sufficiently strong to take the full bridge load and thus the steel is considerably heavier and costlier than a composite concrete and steel structure.

Existing forestry type permanent bridges in one embodiment have precast concrete deck panels with holes or pockets located to rest on the top flanges of steel bridge girders. Shear studs provided in groups are welded to the top flanges of the girders in the location of these holes, the panels are placed on the top flanges of the girders and grout is poured into the holes, thus forming rigid strong connections between the concrete deck panels and the steel bridge girders. Grout is also poured between panels across the bridge to provide increased compression strength between panels. These connections permit composite strength utilizing both the concrete deck panels and the steel girders.

Logging roads are often abandoned after logging or in other cases bridges need to be movable or portable. In some cases the bridge is left in place and this results in wasted material as they are no longer needed. If bridges with bolt down concrete decks are used, then such bridges can be easily disassembled and reused. However, the composite strength bridges presently in use are harder to disassemble and generally the concrete deck panels have to be destroyed, thus only the steel girders and other framework can be reused.

DISCLOSURE OF INVENTION

It has been found that we can make a composite steel girder and concrete deck panel bridge that can be disassembled for reuse. Unlike existing steel girder bridges with bolt down concrete decks, the composite strength bridge uses less steel and thus is cheaper and easier to transport and erect at a bridge site.

It is an aim of the present invention to provide a composite strength steel girder and concrete deck panel bridge wherein the concrete deck panels are removable so both the deck panels and the steel girders can be reused. It is a further aim of the present invention to provide concrete deck panels with holes or pockets positioned for sitting on the top of bridge girders, the holes having smooth inside surfaces so that grout plugs used to fill the holes can be pushed out after disassembly. It is a further aim to provide a plurality or group of shear studs for the bridge girders to fit in the holes in the deck panels and which have removable connections to the top flanges of the bridge girders.

The present invention provides a composite steel girder and concrete deck panel bridge, wherein concrete deck panels are removable for reuse, comprising: precast concrete deck panels, each of the panels having a plurality of holes therein extending through the panels to match stud group locations on top flanges of steel girders, the holes having releasable smooth inside surfaces through the panels, a plurality of shear studs at each of the stud group locations extending up from the top flanges, the plurality of shear studs in the stud group locations having removable connections to the top flanges, and concrete grout filling the holes of the deck panels and between adjacent deck panels to provide a substantially flush deck surface, the concrete grout joining the shear studs and the panels to provide composite strength action between the deck panels and the bridge girders.

In another embodiment of the present invention there is provided a removable attachment between precast concrete deck panels and steel bridge girders comprising: a plurality of holes through each of the deck panels to match stud group locations on top flanges of the bridge girders, the holes having releasable smooth inside surfaces, and a plurality of shear studs at each of the stud group locations on the top flanges to fit within each of the holes of the deck panels, the plurality of shear studs in the stud group locations extending up for at least a portion of the thickness of the deck panels, the shear studs in the stud group locations having threaded members attached thereto extending through the top flanges with retaining nuts on the threaded members.

In a still further embodiment there is provided a method of constructing and attaching precast concrete deck panels to top flanges of steel bridge girders, wherein the deck panels are removable and reusable, comprising the steps of: forming precast concrete deck panels having holes extending through the panels at stud group locations for attachment to the top flanges of the bridge girders, the holes having releasable smooth inside surfaces through the panels, attaching a plurality of shear studs at each of the stud group locations on the top flanges, the plurality of shear studs in the stud group locations held to the top flanges by threaded members extending through the top flanges with attachment nuts on the threaded members below the top flanges, positioning the deck panels on the top flanges of the bridge girders with the holes in the deck panels at each of the stud group locations on the top flanges, and grouting the holes of the deck panels and between adjacent panels to produce a substantially flush deck surface so that the concrete deck panels and the bridge girders provide composite strength action.

BRIEF DESCRIPTION OF DRAWINGS

In drawings which illustrate embodiments of the present invention.

MODES FOR CARRYING OUT THE INVENTION

Figure 1:
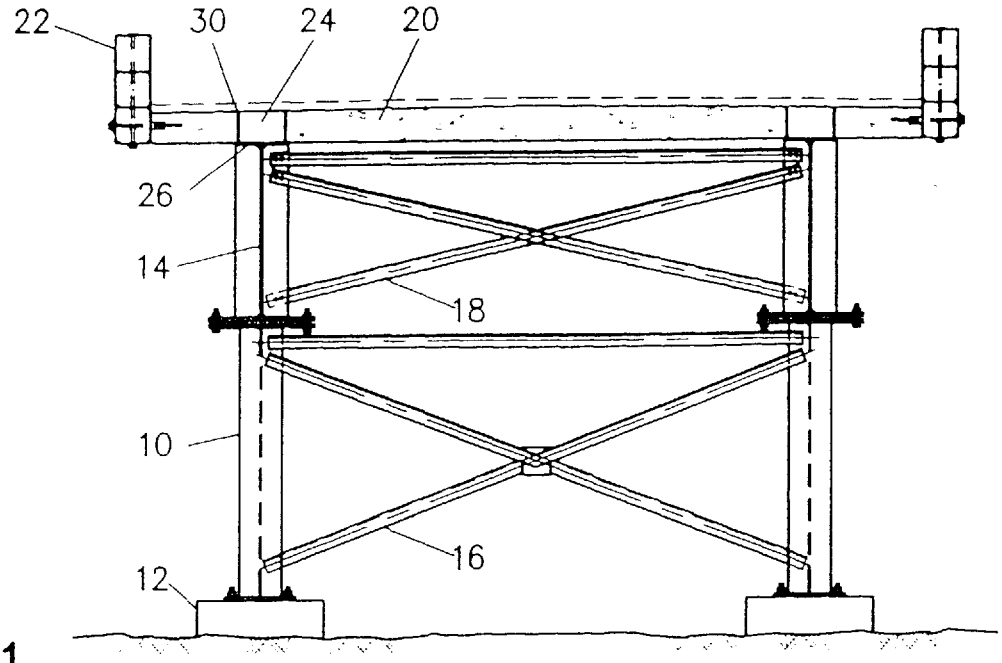
FIG. 1 is a cross-sectional view through a bridge according to the present invention showing a concrete deck panel attached to bridge girders.
Figure 2:
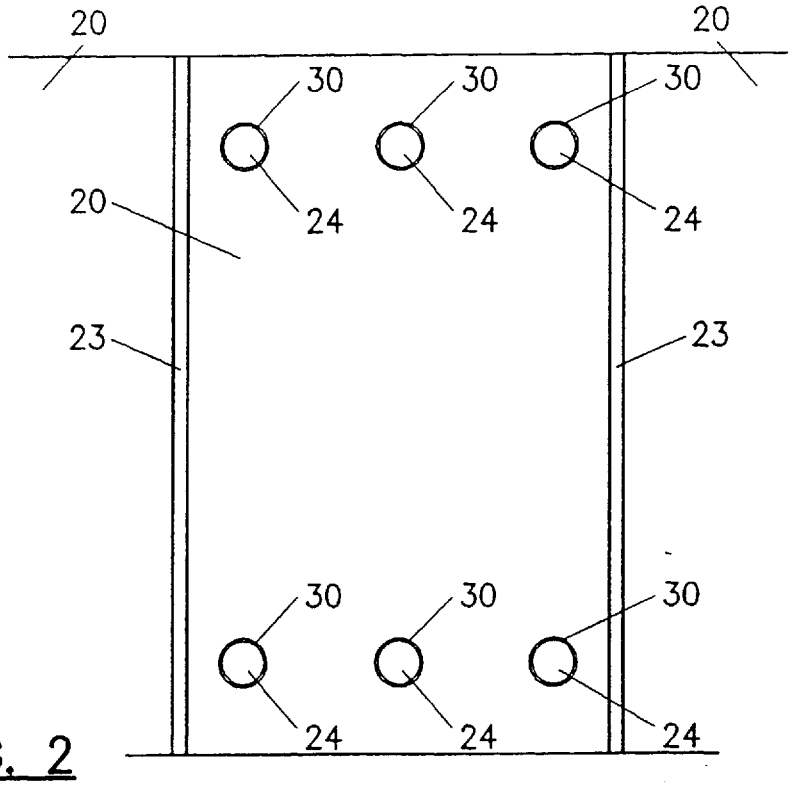
FIG. 2 is a plan view showing deck panels with holes therein for mounting on two spaced apart bridge girders.

A typical forestry bridge is shown in FIG. 1 having a steel column 10 sitting on a levelling pad 12 and steel bridge girder 14 that runs along the length of the bridge. Abutment braces 16 and girder braces 18 are shown attached to the steel column 10 and girder 14 respectively. A precast concrete deck panel 20, as illustrated in FIG. 2, extends across two bridge girders 14 having a timber curb 22 attached to the side edges of the panels 20. Grouting 23 is shown between adjacent deck panels 20 so they do not move under compression forces.

Holes or pockets 24 are positioned over the top flange 26 of the bridge girder 14. Details of the hole 24 together with the attachment to the top flange 26 of the bridge girder 14 will be described hereafter.

As is illustrated, the bridge girders 14, columns 10 and bracing 16,18 are all bolted together and are made to sizes that permit transportation to a bridge site by truck. By utilizing bolts the girders 14 and other members can be assembled on site and can also be disassembled if and when the bridge is to be removed and reused. In some designs welded sections may be used and some site welding may occur in certain cases.

Figure 3:
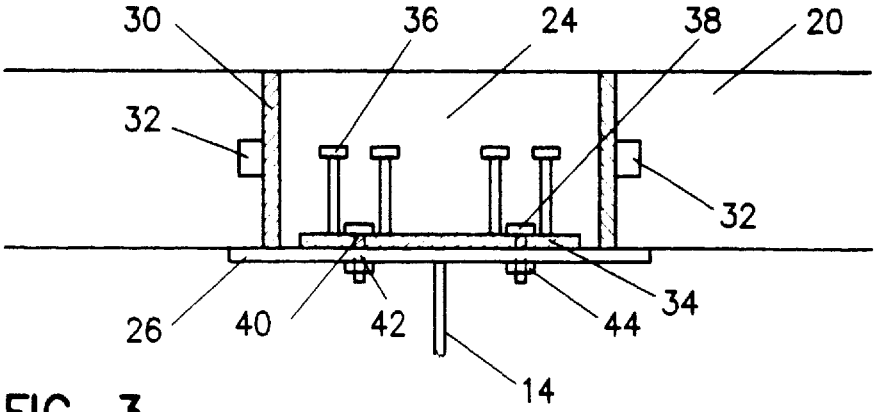
FIG. 3 is a detailed sectional view showing a hole in a deck panel with removable mounting studs arranged in a stud group connected to the top flange of a bridge girder.

A hole 24 is shown in FIG. 3 with a steel pipe section 30, preferably 12" in diameter, acting as a casing to form the hole 24 in the concrete deck panel 20. Steel keeper plates or shear bolts 32 are shown attached on the outside of the steel pipe 30 to ensure that the steel pipe 30 does not move when embedded in the concrete deck panel 20. The inside wall of the steel pipe 30 is substantially smooth and straight. In the embodiment shown it extends for substantially the full depth or thickness of the deck panel 20, the top edge of the steel pipe 30 is below the surface of the deck panel 20 so it is not contacted by vehicles passing over the deck. In another embodiment, as illustrated in a later drawing, it will be seen that the steel pipe 30 terminates before the top surface of the deck panel 20 and a chamfer or tapered edge for grout is provided.

Inside the hole 24 is a plate 34, preferably a ¾" thick steel plate. The plate is shown as being round having a diameter less than the inside diameter of the steel pipe 30. Attached to the plate 34 are a series of shear studs 36 in a stud group which extend up into the hole, in one embodiment the studs extend for at least half the thickness of the concrete deck panel 20. In one embodiment the studs 36, which are preferably ⅞" diameter, are welded to the top of the plate 34.

Attachment bolts 38 are shown passing through holes 40 in the plate 34 and matching holes 42 in the top flange 26 of the girder 14. These bolts 38, which are preferably 1" bolts, have attachment nuts 44 below the top flange 26, and thus hold the plate 34 firmly to the top flange 26.

Figure 4:
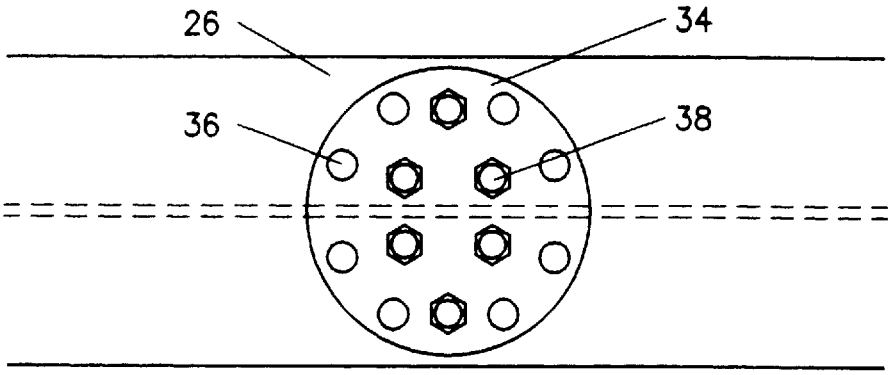
FIG. 4 is a plan view showing an arrangement of shear studs and bolts on a plate mounted on a bridge girder.

FIG. 4 shows one embodiment of a stud group arrangement of studs 36 and bolts 38. As can be seen, there are eight studs that extend up into the hole 24 and six bolts 38 that hold the plate 34 to the top flange 26 of the bridge girder 14. The number of studs 36 and the number of bolts 38 depends on the length of the bridge and the design weight of the vehicle to pass over the bridge. In a preferred embodiment at least six studs 36 are provided. Different numbers, sizes and arrangements of studs 36 and bolts 38 may be provided to suit different design requirements.

In operation the precast deck panels 20 are formed with pipe sections 30 therein to form the holes 24. The shear studs 36 are welded to the round plate 34 in a designed stud group pattern similar to that shown in FIG. 4, and the plate 34 is then positioned on the top flange 26 of the bridge girder 14 and bolted to the top flange 26 by bolts 38 with attachment nuts 44 underneath the flange 26.

Before the deck panel 20 is positioned on the girders 14, a releasable coating or bond breaker is applied to the inside walls of the pipe sections 30 to ensure that at a later date the grout plug cast therein may be removable. The deck panel 20 is then placed in position on the girders with the holes 24 over the plates 34 bolted to the top flanges 26 of the girders 14. The holes 24 are then filled with high strength non-shrink grout so that the top of the grout is substantially flush with the top surface of the deck panel 20. At the same time grout is poured in the gap 23 between adjacent panels 20 as is seen in FIG. 2. Once the grout has set, there is rigid connection between the concrete deck panel 20 and the steel girders 14 sufficient for composite strength of both the steel and the concrete to apply. Thus, the concrete deck panels 20 contribute to the strength of the bridge in both tension and compression and are not simply deck panels 20 that are bolted or laid upon the top of the steel girders 14.

If and when the bridge is to be disassembled and removed from the site, the attachment nuts 44 on the underside of the girder top flanges 26 are removed from bolts 38 and this in turn permits the concrete deck panels 20 to be lifted off the bridge girders 14. The grout in the hole 24 is then removed. This grout plug generally comes out in one piece, alternatively, some chipping may have to take place around the edges, however, because of the releasable coating on the inside of the pipe 30, the grout is removable and can be discarded together with the old plate 34, shear studs 36 and bolts 38. The deck panel 20 is then ready for installation in another bridge. For reuse it is necessary to have a new series of shear studs 26, bolts 38 together with plate 34 for each hole 24 positioned on the top flanges 26 of the next bridge girders 14.

Figure 5:
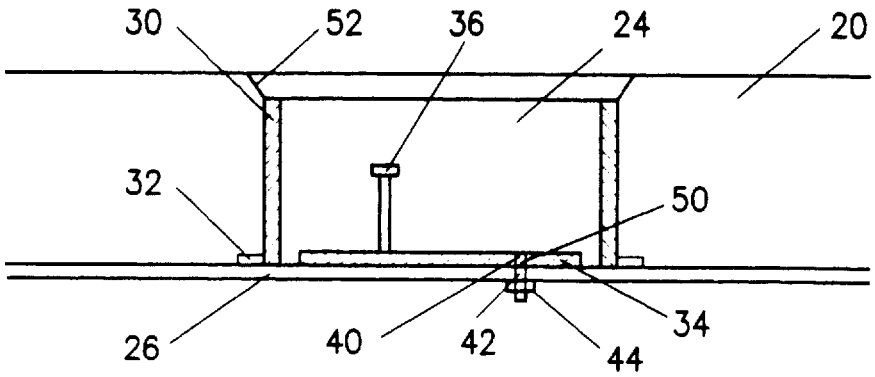
FIG. 5 is a detailed sectional view showing another embodiment of a hole in a deck panel with a plate having shear studs mounted thereon and threaded members for holding the plate to the top flange of a bridge girder.

A further embodiment of a removable attachment between a concrete panel 20 and the top flange 26 of a bridge girder 14 is shown in FIG. 5. In this embodiment the plate 34 has separate attachment bolts or attachment studs 50 inserted through holes 40 in the plate 34. If bolts are used, then the head of the bolt is cut off and the shank of the bolt plug welded in hole 40 to hold the threaded portion 50 extending down passing through the hole 42 in the top flange 26 for an attachment nut 44. In this configuration the bolts 38, as shown in FIGS. 3 and 4, do not extend up past the top surface of the plate 34 and the plate itself is flush other than the shear studs 36 extending therefrom. As shown in FIG. 5, the pipe section 30 in the hole 24 does not extend up to the top surface of the concrete deck panel 20 but ends just before the top surface and a chamfer portion 52 is provided. When the high strength grout is used to fill the hole 24 the grout overlaps this chamfer portion 52, thus when it is time for the grout to be removed it is generally necessary to chisel out around the edge of the grout. The grout plug can generally be removed either upwards or downwards.

Figure 6:
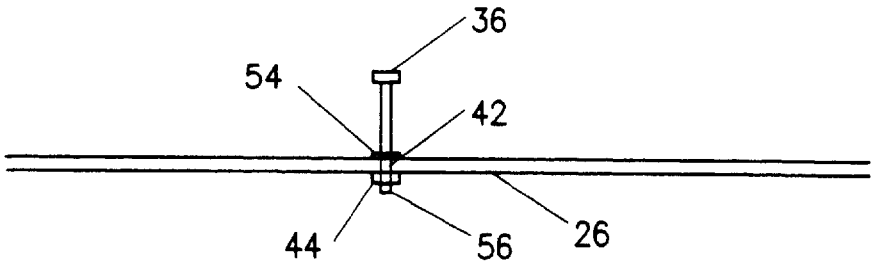
FIG. 6 is a detailed sectional view showing yet a further embodiment of a combined shear stud with a threaded portion extending through the top flange of a bridge girder.

FIG. 6 illustrates a further embodiment wherein the stud 36 has a retaining washer 54 tack welded to the stud 36 which rests on the top flange 26 with the lower portion of the stud 36 passing through hole 42 in the top flange 26. The attachment nut 44 engages the threaded portion 56 of the stud 36. In this embodiment the studs 36 may be positioned directly onto the top flange 26 without the necessity of using a plate 34 as shown in FIGS. 3, 4 and 5. When the panels 20 are to be removed, it is necessary to remove the attachment nuts 44 and lift the panels 20 off the bridge girders 14.

Figure 7:
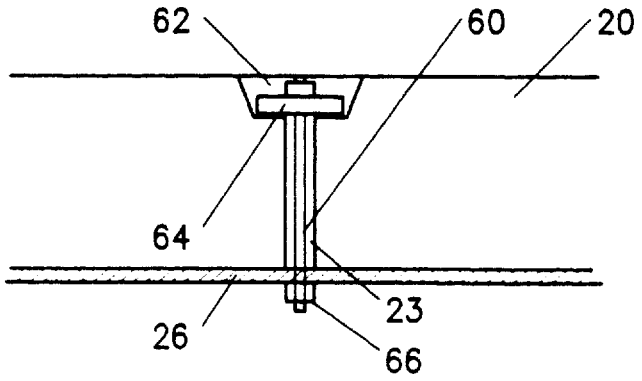
FIG. 7 is a cross-sectional view showing adjoining concrete deck panels with hold down bolts therein.

Because the grout plug joins to the surface of the holes 24 with what is referred to as a "releasable" surface, in some instances when the upward forces on the deck panels 20 exceed the weight of the panels, it is necessary to hold the deck panels 20 to the top flanges 26 of the girders 14. In FIG. 7 is illustrated a hold down bolt 60 that passes through the grout 23 between adjacent panels 20 and has a keeper plate 62 at the top to rest on shoulder pockets 64 on each side of adjacent panels 20. The bolt 60 extends down through the flange 26 and has a nut 66 that holds the panel in place. Removal of the nut 66 when the nuts 44 for the bolts 38 are removed permits the panels 20 to be removed.

Figure 8:
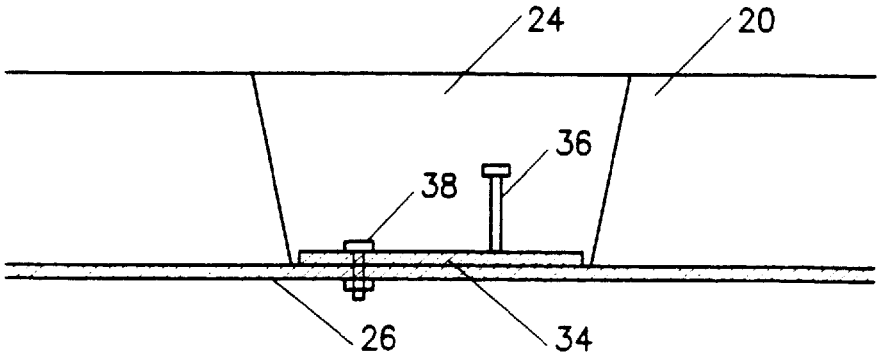
FIG. 8 is a detailed sectional view showing a frusto-conical shaped hole for a grout plug at the stud group location.

Another arrangement to hold the panels to the top flanges 26 is shown in FIG. 8 where the hole 24 is frusto-conical in shape with the smaller diameter at the bottom of the panel 20. In this configuration the grout plug, which is held to the flange 26 by the studs 36 and bolts 38, prevents the panel 20 from lifting up. When the panel 20 is disassembled for reuse, the grout plug must be pushed out in an upward direction. The shape of the hole 24 may be formed with a frusto-conical shaped wooden form at the time of forming the deck panel. The form may then be removed. Alternatively, the hole 24 may be lined with sheet steel or plastic material.

Figure 9:
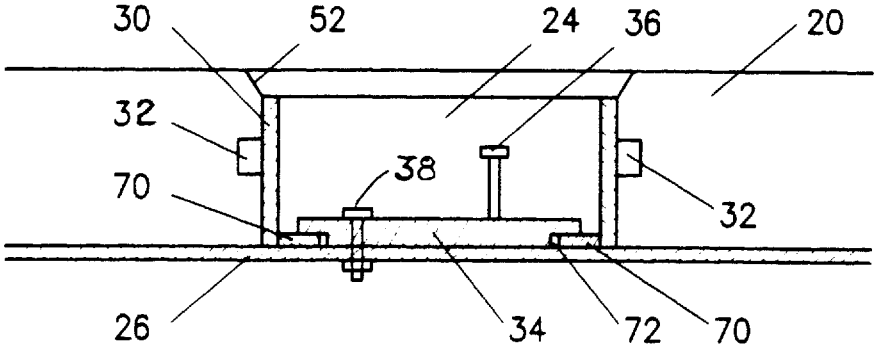
FIG. 9 is a detailed sectional view showing a pipe lined hole with retainer clips to ensure the panels do not separate from the bridge girders.

FIG. 9 illustrates another hold down device wherein retainer clips 70 are welded to the inside bottom of a steel pipe section 30 similar to that shown in FIG. 3. The plate 34 has a shoulder portion 72 which rests on the retainer clips 70. Thus, the grout plug prevents the panels 20 from being raised up. For disassembly, the grout plug can only be removed upwards.

Whereas a steel pipe section 30 is shown in the hole 24, in another embodiment the hole may be formed without a steel pipe, or may have a plastic or sheet metal lining, the side walls or surfaces of the hole 24 in the concrete panel 20 have to be smooth and releasable so that the grout plug can be removed if the panel 20 is to be reused.

Various changes may be made to the embodiments shown herein without departing from the scope of the present invention which is limited only by the following claims.

I claim:

1. A composite steel girder and concrete deck panel bridge, wherein concrete deck panels are removable for reuse, comprising:

precast concrete deck panels, each of the panels having a plurality of holes therein extending through the panels to match stud group locations on top flanges of steel girders, the holes having releasable smooth inside surfaces through the panels;

a plurality of shear studs at each of the stud group locations extending up from the top flanges, the plurality of shear studs in the stud group locations having removable connections to the top flanges, and concrete grout filling the holes of the deck panels and between adjacent deck panels to provide a substantially flush deck surface, the concrete grout joining the shear studs and the panels to provide composite strength action between the deck panels and the bridge girders.

2. The composite bridge according to claim 1 wherein the holes extending through the deck panels are circular, the holes having inside walls perpendicular to surfaces of the deck panels.

3. The composite bridge according to claim 2 including a steel pipe lining each of the plurality of holes through the deck panels.

4. The composite bridge according to claim 3 wherein the steel pipe is at least 12" nominal diameter.

5. The composite bridge according to claim 3 wherein the steel pipe has retaining means to retain the pipe in the deck panel.

6. The composite bridge according to claim 2 including a smooth coating on the inside walls of the circular holes.

7. The composite bridge according to claim 1 wherein the shear studs are attached to a plate, the plate fitting within the hole and having bolts extending through the plate and the top flange of the steel girders, held in place by attachment nuts under the top flange.

8. The composite bridge according to claim 1 wherein the shear studs are attached to a plate, the plate fitting within the hole and having separate threaded members extending down to pass through holes in the top flange and held in place by attachment nuts on the threaded members under the top flange.

9. The composite bridge according to claim 1 wherein the shear studs have threaded portions extending down to pass through holes in the top flange, the threaded portions being held in place by attachment nuts under the top flange, the shear studs having retaining means resting on top of the top flange at the holes.

10. The composite bridge according to claim 1 including at least six shear studs at each of the stud group locations.

11. The composite bridge according to claim 7 including at least six bolts at each of the stud group locations extending through the plate and the top flange of the steel girders to hold the plate to the top flange by attachment nuts.

12. The composite bridge according to claim 11 wherein the bolts are 1" diameter nominal size and the studs are ⅞" diameter nominal size.

13. The composite bridge according to claim 10 wherein the studs extend up from the top flange for at least half the thickness of the concrete deck panels.

14. The composite bridge according to claim 1 including hold down bolts in the concrete grout between adjacent deck panels holding the deck panels to the bridge girders.

15. The composite bridge according to claim 1 wherein the holes are frusto-conical in shape with a smaller diameter at the bottom of the panels.

16. The composite bridge according to claim 5 including retainer clips attached at the inside surface at the base of the steel pipe lining, and wherein the shear studs are attached to a plate, the plate fitting within the steel pipe lining having a shoulder to engage with the retainer clips, the plate having bolts extending through the plate and the top flange of the steel girders, held in place by attachment nuts under the top flange.

17. A removable attachment between precast concrete deck panels and steel bridge girders, comprising:

a plurality of holes through each of the deck panels to match stud group locations on top flanges of the bridge girders, the holes having releasable smooth inside surfaces; and a plurality of shear studs at each of the stud group locations on the top flanges to fit within each of the holes of the deck panels, the plurality of shear studs in the stud group locations extending up for at least a portion of the thickness of the deck panels, the shear studs in the stud group locations having threaded member attached thereto extending through the top flanges with attachment nuts on the threaded members under the top flanges;

wherein the plurality of shear studs are arranged in a group pattern attached to a plate in each of the plurality of holes, the plate having bolts extending through the plate and the top flange and held in place by attachment nuts under the top flange.

18. The removable attachment according to claim 17 including a steel pipe lining in each of the plurality of holes extending through the deck panels, the steel pipe being fixed to the panels.

19. The removable attachment according to claim 17 wherein the holes are frusto-conical in shape with a smaller diameter at the bottom of the panels.

20. A removable attachment between precast concrete deck panels and steel bridge girders, comprising:

a plurality of holes through each of the deck panels to match stud group locations on top flanges of the bridge girders, the holes having releasable smooth inside surfaces;

a plurality of shear studs at each of the stud group locations on the top flanges to fit within each of the holes of the deck panels, the plurality of shear studs in the stud group locations extending up for at least a portion of the thickness of the deck panels, the shear studs in the stud group locations having threaded member attached thereto extending through the top flanges with attachment nuts on the threaded members under the top flanges;

a steel pipe lining in each of the plurality of holes extending through the deck panels, the steel pipe being fixed to the panels; and retainer clips attached to the inside surface at the base of the steel pipe lining;

wherein the plurality of shear studs are arranged in a group pattern attached to a plate fitting within the steel pipe lining having a shoulder to engage with the retainer clips, the plate having bolts extending through the plate and the top flange of the steel girders, held in place by attachment nuts under the top flange.

21. A method of constructing and attaching precast concrete deck panels to top flanges of steel bridge girders, wherein the deck panels are removable and reusable, comprising the steps of:

forming precast concrete deck panels having holes extending through the panels at stud group locations for attachment to the top flanges of the bridge girders, the holes having releasable smooth inside surfaces through the panels;

attaching a plurality of shear studs at each of the stud group locations on the top flanges, the plurality of shear studs in the stud group locations held to the top flanges by threaded members extending through the top flanges with attachment nuts on the threaded members below the top flanges;

positioning the deck panels on the top flanges of the bridge girders with the holes in the deck panels at each of the stud group locations on the top flanges, and grouting the holes of the deck panels and between adjacent panels to provide a substantially flush deck surface so that the concrete deck panels and the bridge girders provide composite strength action.

22. The method of constructing according to claim 21 including the steps of reusing the deck panels by removing the attachment nuts from the threaded members below the top flanges, raising the deck panels and separating them from the top flanges of the bridge girders and knocking out grout from the holes in the deck panels so the deck panels may be reused.

23. The method of constructing according to claim 21 wherein the holes are round holes having inside walls perpendicular to surfaces of the deck panels.

24. The method of constructing according to claim 22 wherein the holes are frusto-conical in shape with a smaller diameter at the bottom of the deck panels.

25. The method of constructing according to claim 23 including a steel pipe located in each of the holes in the deck panels.

26. The method of constructing according to claim 21 including applying a smooth coating on the inside walls of the holes prior to grouting the holes.

27. The method of constructing according to claim 21 wherein there are at least six shear studs mounted on a plate, the plate being bolted to the top flange of each bridge girder.

28. The method of constructing according to claim 25 including retaining the steel pipe to the top flange of each bridge girder by retaining clip means attached to the inside surface at the base of the steel pipe and a plate in the steel pipe engaging the retaining clip means and having bolts extending through the plate and the top flange of the steel girders, held in place by attachment nuts under the top flange.

* * * * *